US007801474B2

(12) United States Patent
Nishinoue

(10) Patent No.: US 7,801,474 B2
(45) Date of Patent: Sep. 21, 2010

(54) FIXING DEVICE AND IMAGE FORMING APPARATUS HAVING FIXING DEVICE

(75) Inventor: Kazunori Nishinoue, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 69 days.

(21) Appl. No.: 12/195,173

(22) Filed: Aug. 20, 2008

(65) Prior Publication Data

US 2009/0052957 A1 Feb. 26, 2009

(30) Foreign Application Priority Data

Aug. 20, 2007 (JP) ..... 2007-213740

(51) Int. Cl.
*G03G 15/20* (2006.01)

(52) U.S. Cl. ..... 399/329

(58) Field of Classification Search ..... 399/329, 399/328, 331; 219/216; 347/156
See application file for complete search history.

(56) References Cited

U.S. PATENT DOCUMENTS

2007/0196145 A1* 8/2007 Matsumoto et al. ..... 399/329
2008/0219725 A1* 9/2008 Saiki ..... 399/329

FOREIGN PATENT DOCUMENTS

JP 8-137310 5/1996
JP 2002-117959 4/2002
JP 2003-5553 A 1/2003
JP 2004-198695 A 7/2004
JP 2005-4126 A 1/2005
JP 2005-62568 A 3/2005
JP 2006-84655 3/2006
JP 2006-99144 4/2006

OTHER PUBLICATIONS

Japanese Office Action mailed Aug. 11, 2009, directed to counterpart Japanese Patent Application No. 2007-213740; 7 pages.
Japanese Office Action mailed Feb. 23, 2010, directed to counterpart Japanese Patent Application No. JP 2007-213740; 8 pages.

* cited by examiner

*Primary Examiner*—Sophia S Chen
(74) *Attorney, Agent, or Firm*—Morrison & Foerster LLP

(57) ABSTRACT

A fixing device of the present invention includes a holding frame placed along a fixed pressing member. The holding frame includes a groove section having a recessed cross section and extending along the width direction of a sheet. The fixed pressing member is housed in the groove section. The fixed pressing member is pressed toward the rotor so that the rotor and the fixed pressing member are put in pressure contact with each other. A first engaging element is provided in a predetermined position on the bottom face of the groove section of the holding frame. A second engaging element which engages with the first engaging element is provided in a position on the fixed pressing member which corresponds to the positions of the first engaging element on the holding frame.

18 Claims, 5 Drawing Sheets

Fig.7B RELATION BETWEEN PRESSURE PAD POSITION AND NIP WIDTH

FIXING DEVICE AND IMAGE FORMING APPARATUS HAVING FIXING DEVICE

This application is based on an application No. 2007-213740 filed in Japan, the contents of which are hereby incorporated by reference.

BACKGROUND OF THE INVENTION

The present invention relates to a fixing device and an image forming apparatus having the fixing device.

As a general fixing device, one composed of a rotor and an endless belt, which form a nip section for fixing an image onto a conveyed sheet, a pressure member which comes into sliding contact with the inner surface of the endless belt, and a heating section for heating either one of the rotor and the endless belt to a fixing temperature is known (See JP 2003-5553 A, JP 2005-4126 A, JP 2004-198695 A, JP 2005-62568 A, and JP H8-137310 A). The pressure member is composed of a holding frame which includes a groove section having a recessed cross section and extending along the width direction of the sheet, and a pressing member housed in the groove section of the holding frame. The pressing member is pressed toward the rotor so that the rotor and the endless belt are put in pressure contact with each other.

Generally, this kind of pressure member suffers displacement of the pressing member during assembling operation for housing the fixed pressing member into the holding frame as well as during operation for solving such problem as sheet jam. Accordingly, it has been known, as shown in FIG. 7A, that the displacement of the pressing member with respect to a conveyance direction of a sheet (referred to as "pressure pad position moving amount" in the horizontal axis of FIG. 7A) changes a ratio of the conveyance speed of both end sections of the sheet to the conveyance speed of a central section of the sheet (referred to as "paper sheet conveyance speed ratio" in the vertical axis of FIG. 7A). When the conveyance speed ratio is 0.2% or more, paper wrinkling tends to occur. It is also known, as shown in FIG. 7B, that change in pressure pad position moving amount changes the nip width, which may deteriorate the fixing quality of the fixing operation (symbol □ in FIG. 7B shows variation of the central section and symbol ◇ shows variation of the drive side).

SUMMARY OF THE INVENTION

Accordingly, an object of the present invention is to provide a fixing device capable of stably positioning the fixed pressing member housed in the holding frame and thereby preventing the fixed pressing member from being displaced in the conveyance direction of the sheet, and to provide an image forming apparatus having the fixing device.

In order to accomplish the above object, a fixing device of a first aspect of the present invention comprises:

a rotor and a fixed pressing member for forming a nip section for fixing an image onto a conveyed sheet, the rotor and the fixed pressing member extending along a width direction of the sheet;

a heating section for heating the rotor to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the fixed pressing member are put in pressure contact with each other, and wherein a first engaging element is provided in a predetermined position on a bottom face of the groove section of the holding frame, while a second engaging element which engages with the first engaging element is provided in a position on the fixed pressing member, the position corresponding to the first engaging element of the holding frame.

In the fixing device of the first aspect, by virtue of engagement of the first engaging element provided on the bottom face of the groove section of the holding frame with the second engaging element, the fixed pressing member is constantly held in a stable position with respect to the rotor in the conveyance direction of the sheet. This makes it possible to prevent the fixed pressing member from being displaced with respect to the sheet conveyance direction during assembling operation for housing the fixed pressing member into the holding frame as well as during operation for solving such problem as sheet jam. By preventing the displacement of the fixed pressing member, it becomes possible to prevent increase in paper sheet conveyance speed ratio, that is a ratio of the conveyance speed of both the end sections of the sheet to the conveyance speed of the central section of the sheet, as well as to prevent variation of the nip width. Therefore, it becomes possible to solve problems such as paper wrinkling, poor paper feed and insufficient fixing strength caused by the displacement, and to stabilize the sheet conveyance, resulting in enhancement of fixing quality.

A fixing device of a second aspect of the present invention comprises:

a rotor and an endless belt for forming a nip section for fixing an image onto a conveyed sheet;

a fixed pressing member which comes into sliding contact with an inner surface of the endless belt, the rotor, the endless belt and the fixed pressing member extending along a width direction of the sheet;

a heating section for heating either one of the rotor and the endless belt to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the endless are put in pressure contact with each other, and wherein a first engaging element is provided in a predetermined position on a bottom face of the groove section of the holding frame, while a second engaging element which engages with the first engaging element is provided in a position on the fixed pressing member, the position corresponding to the first engaging element of the holding frame.

In the fixing device of the second aspect, as with the first aspect, by virtue of engagement of the first engaging element provided on the bottom face of the groove section of the holding frame with the second engaging element, the fixed pressing member is constantly held in a stable position with respect to the rotor in the conveyance direction of the sheet. This makes it possible to prevent the fixed pressing member from being displaced with respect to the sheet conveyance direction during assembling operation for housing the fixed pressing member into the holding frame as well as during operation for solving such problem as sheet jam. By preventing the displacement of the fixed pressing member, it becomes possible to prevent increase in paper sheet conveyance speed ratio, that is a ratio of the conveyance speed of both the end sections of the sheet to the conveyance speed of the central section of the sheet, as well as to prevent variation of the nip width. Therefore, it becomes possible to solve problems such as paper wrinkling, poor paper feed and insufficient fixing strength caused by the displacement, and to stabilize the sheet conveyance, resulting in enhancement of fixing quality.

An image forming apparatus of a third aspect of the present invention comprises:

an image forming section for attaching toner to a sheet; and a fixing device for fixing the toner onto the sheet, the fixing device comprising:

a rotor and a fixed pressing member for forming a nip section for fixing an image onto a conveyed sheet, the rotor and the fixed pressing member extending along a width direction of the sheet;

a heating section for heating the rotor to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the fixed pressing member are put in pressure contact with each other, and wherein a first engaging element is provided in a predetermined position on a bottom face of the groove section of the holding frame, while a second engaging element which engages with the first engaging element is provided in a position on the fixed pressing member, the position corresponding to the first engaging element of the holding frame.

An image forming apparatus of a fourth aspect of the present invention comprises:

an image forming section for attaching toner to a sheet; and a fixing device for fixing the toner onto the sheet, the fixing device comprising:

a rotor and an endless belt for forming a nip section for fixing an image onto a conveyed sheet;

a fixed pressing member which comes into sliding contact with an inner surface of the endless belt, the rotor, the endless belt and the fixed pressing member extending along a width direction of the sheet;

a heating section for heating either one of the rotor and the endless belts to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the endless are put in pressure contact with each other, and wherein a first engaging element is provided in a predetermined position on a bottom face of the groove section of the holding frame, while a second engaging element which engages with the first engaging element is provided in a position on the fixed pressing member, the position corresponding to the first engaging element on the holding frame.

In the image forming apparatus in the third and fourth aspects of the present invention, the fixed pressing member is constantly held in a stable position with respect to the rotor in the sheet conveyance direction, and therefore it becomes possible to prevent the fixed pressing member from being displaced with respect to the sheet conveyance direction during assembling operation for housing the fixed pressing member into the holding frame as well as during operation for solving such problem as sheet jam. Moreover, by providing a pressing section, it becomes possible to prevent the fixed pressing member from being displaced toward an upstream side of the sheet conveyance direction by conveyance of the sheet, so that positioning accuracy in the sheet conveyance direction can be enhanced. Accordingly, it becomes possible to prevent increase in paper sheet conveyance speed ratio, that is a ratio of the conveyance speed of both the end sections of the sheet to the conveyance speed of the central section of the sheet, as well as to prevent variation of the nip width. Therefore, it becomes possible to structure an image forming apparatus, which can solve problems such as paper wrinkling, poor paper feed and insufficient fixing strength, stabilize sheet conveyance and enhance fixing quality, by including the fixing device in the image forming apparatus.

BRIEF DESCRIPTION OF THE DRAWINGS

The present invention will become more fully understood from the detailed description given hereinbelow and the accompanying drawings, which are given by way of illustration only and thus are not limitative of the present invention, and wherein:

FIG. 7B is a view showing an experimental result regarding the relation between a pressure pad position of the fixing device and a nip width.

DETAILED DESCRIPTION OF THE PREFERRED EMBODIMENT

Hereinbelow, the present invention will be described in details in conjunction with the embodiments with reference to the drawings.

Figure 1:
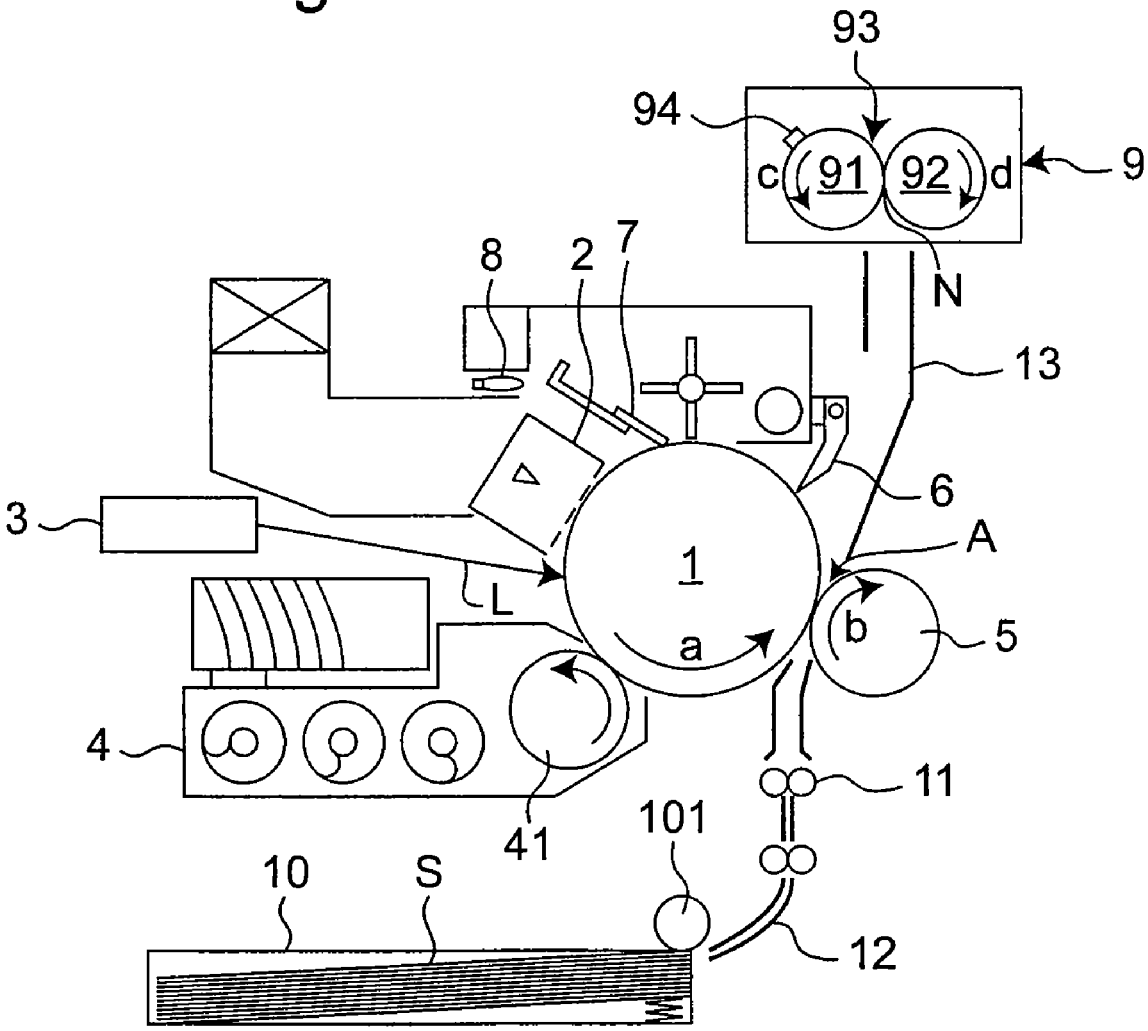
FIG. 1 is a view showing a configuration of an image forming apparatus having a fixing device of one embodiment of the present invention.

FIG. 1 shows a configuration of an image forming apparatus having a fixing device in one embodiment.

The image forming apparatus has a photoconductor drum 1 at generally the central section inside a casing (not shown), and around the photoconductor drum 1, a charging unit 2, an image exposure device 3, a developing device 4 having a developing roller 41, a transfer roller 5, a separating claw 6, a cleaner 7, and an eraser 8 are provided in this order. These components 1 to 8 constitute the image forming section. The photoconductor drum 1 and the transfer roller 5 are put in pressure contact with each other to form a nip section (transfer region) A for image formation.

A paper cassette 10 for storing a number of sheets (paper sheet etc.) S as recording media is placed below the transfer region A in the casing.

A fixing device 9 is placed above the transfer region A in the casing. The fixing device 9 has two members 91, 92 which are put in pressure contact with each other so as to form a nip section N for fixing operation. These members 91, 92 can respectively take the form of a cylindrical roller or an endless belt (the details will be described later). In this example, the member 91 is heated to a fixing temperature by a later-described heating section. Placed around the member 91 are a separating claw 93 for separating the sheets S from the member 91 and a thermistor 94 for detecting the temperature of the member 91.

In this example, the sheets S of A4 size (according to Japanese Industrial Standards) are stored in the paper cassette 10 so as to be fed from the longitudinal direction of the sheets S. A conveyance path 12 for conveying the sheets S sent out from the paper cassette 10 is formed between the paper cassette 10 and the transfer region A. A conveyance path 13 for conveying the sheets S with toner attached thereto in the transfer region A is formed between the transfer region A and the fixing device 9.

At the time of image formation, the photoconductor drum 1 is rotated in the direction of arrow a (counterclockwise in FIG. 1), and the transfer roller 5 is rotated in the direction of arrow b (clockwise in FIG. 1), both around their respective centers. The surface of the photoconductor drum 1 is uniformly charged to a specified potential by the charging unit 2, and a laser beam L corresponding to a manuscript image is applied to the charged area from the image exposure device 3, by which an electrostatic latent image is formed on the surface of the photoconductor drum 1. The electrostatic latent image is developed into a visible toner image by the developing roller 41 of the developing device 4 with a developing bias applied thereto.

The sheets S are pulled out from the paper cassette 10 sheet by sheet by a feed roller 101 into the conveyance path 12, and are fed to a pair of timing rollers 11. The timing rollers 11 send the sheets S into the transfer region A in synchronization with formation of a toner image on the photoconductor drum 1 under the control by an unshown control section. Accordingly, the toner image formed on the photoconductor drum 1 is transferred and attached to the sheet S. The toner remaining on the surface of the photoconductor drum 1 after the transfer is cleaned and removed by the cleaner 7. The electric charge remaining on the surface of the photoconductor drum 1 is discharged and removed by the eraser 8. Thus, the preparation for the subsequent image formation is completed.

The sheet S with the toner image attached thereto is sent from the transfer region A to the nip section N between the two members 91, 92 of the fixing device 9 through the conveyance path 13. During fixing operation, the two members 91, 92 are rotated in the direction of arrow c and the direction of arrow d, respectively. One member 91 is heated to a fixing temperature by a heating section (e.g., a heater 95 in FIG. 2A). The temperature of the member 91 is subjected to feedback control by an unshown control section based on the temperature detected by the thermistor 94. The sheet S sent into the nip section N receives pressure and heat while being conveyed through the nip section N, by which the toner thereon is melted. Consequently, an image is fixed onto the sheet S. The sheet S with the image fixed thereon is discharged upward through the nip section N in this example.

Figure 2:
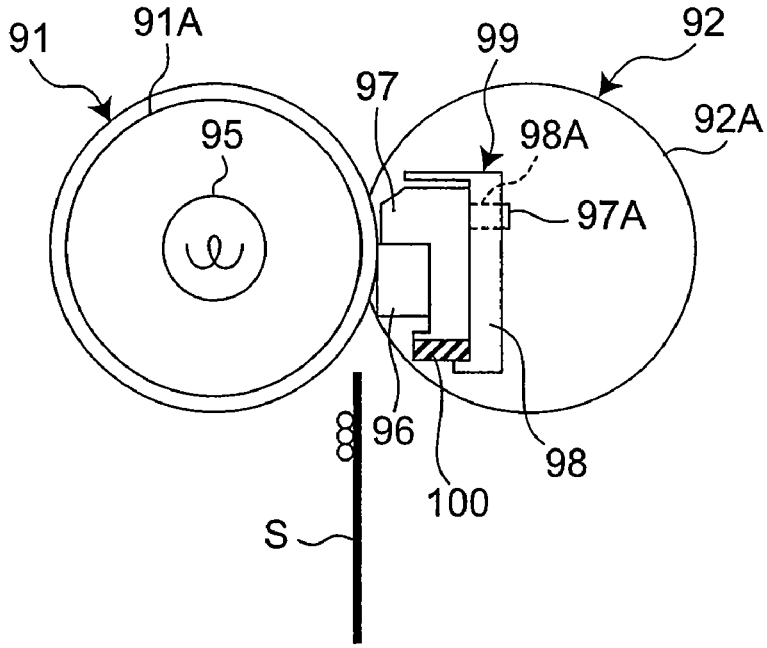
FIG. 2 is a view showing one specific configuration example of the fixing device in FIG. 1.

FIG. 2 shows a concrete configuration example of the above-mentioned fixing device 9. In this configuration example, the fixing device 9 has a heating roller (shown with reference numeral 91A) which has the form of a cylindrical roller extending along the width direction of the sheet S as the member 91, and a pressure belt (shown with reference numeral 92A) which has the form of an endless belt 92. A heater 95 as a heating section is provided inside the heating roller 91A. Inside the pressure belt 92A, as a pressure member 99 which presses the inner surface of the pressure belt 92A toward the heating roller 91A, an elastic pad 96 is provided in the upstream area with respect to the conveyance direction of the sheets, and a fixed pressing member 97 is provided in a further downstream area. The elastic pad 96 and the fixed pressing member 97 are supported by a holding frame 98 and are biased toward the heating roller 91A.

Figure 3:
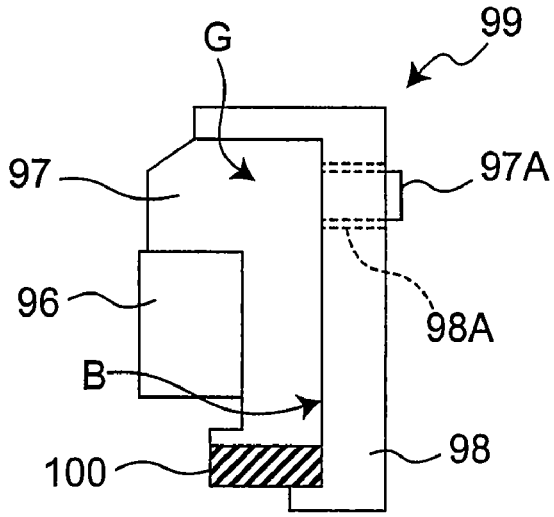
FIG. 3 is a detail view showing a pressure member shown in FIG. 2.

FIG. 3 shows a concrete configuration of the above-mentioned pressure member 99. In this configuration example, the fixed pressing member 97 extends along the width direction of the sheet S together with the heating roller 91A and the pressure belt 92A. The holding frame 98 is placed along the fixed pressing member 97 on the opposite side of the heating roller 91A with respect to the fixed pressing member 97.

The holding frame 98, which is formed of metal drawn material, extruded material or sheet metal such as aluminum and iron, includes a groove section G having a recessed cross section and extending along the width direction of the sheet S. The fixed pressing member 97 is housed in the groove section G. In addition, the holding frame 98 presses the fixed pressing member 97 toward the heating roller 91A so that the heating roller 91A and the fixed pressing member 97 are put in pressure contact with each other. A through hole 98A as a first engaging element is provided so as to penetrate a bottom face B of the groove section G of the holding frame 98.

The fixed pressing member 97 is made from materials including resin such as polyphenylene sulfido, polyimide and liquid crystal polymer, metal such as aluminum and iron, and ceramics. Further, the fixed pressing member 97 has a projection 97A as a second engaging element which engages with the holding frame 98 at a position corresponding to the through hole 98A of the holding frame 98. In this example, the projection 97A is made of a pin having a circular cross section (see FIG. 5). A silicone rubber 100 as a pressing section is mounted on the holding frame 98. The silicone rubber 100 presses the fixed pressing member 97 toward the holding frame 98 in the direction which is equivalent to a downstream direction with respect to the conveyance direction of the sheet S. The silicone rubber 100 should preferably be structured to have a thickness of 0.1 mm or more and 10 mm or less. Without being limited to the silicone rubber 100, the material of the pressing section may be any elastic body such as fluororubber, more preferably with higher heat resistance. From a viewpoint of mountability and productivity, the pressing section may be formed integrally with a metal plate made of stainless steel copper (SUS), aluminum, iron and the like.

Figure 4:
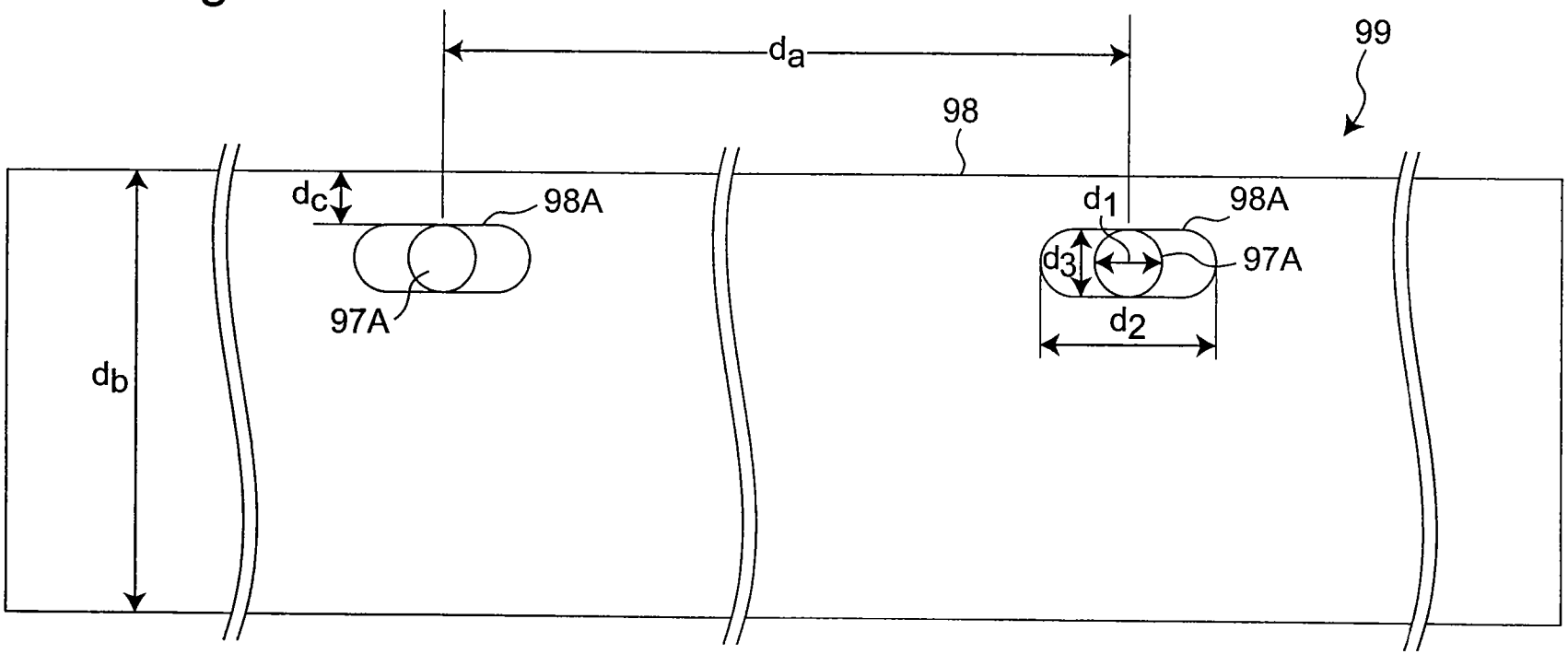
FIG. 4 is a detail view showing a pressure member shown in FIG. 2.

FIG. 4 shows a concrete configuration of the rear face of the above-mentioned pressure member 99 (equivalent to the pressure member 99 of FIG. 3 seen from the right-hand side). In the configuration example, the holding frame 98 extends along the width direction of the sheet S (the horizontal direction in FIG. 4, and accordingly referred to as "longitudinal direction"), and has a width size $d_b$=20 mm with respect to the conveyance direction of the sheet S (the vertical direction in FIG. 4, and accordingly referred to as "short direction"). The through hole 98A is provided in two locations on the holding frame 98 which are distanced from each other with respect to the longitudinal direction. More specifically, the distance $d_a$ between the through holes 98A and 98A is set to 200 mm. Furthermore, each through hole 98A is placed so that a distance $d_c$ from a position equivalent to the upper side with respect to the short direction, i.e., a distance $d_c$ from a downstream position with respect to the conveyance direction of the sheet S, more specifically, a distance $d_c$ from the upper end of the holding frame 98 is 1 mm or more and 5 mm or less. The projection 97A provided on the fixed pressing member 97 is provided in two locations corresponding to the respective through holes 98A of the holding frame 98.

Figure 5:
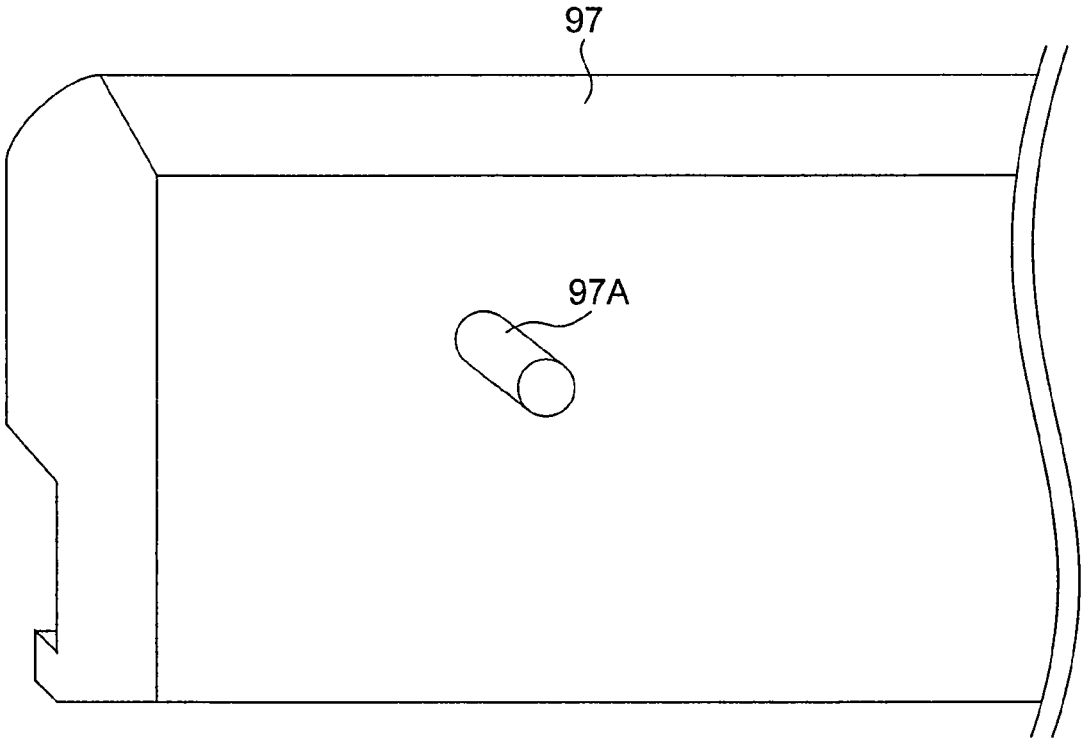
FIG. 5 is a detail view showing a fixed pressing member in FIG. 2.

As shown in FIG. 4 and FIG. 5, the projection 97A in this example is constituted of a pillar having a cross-sectional diameter $d_1$ of 2 mm. In actuality, in consideration of allowance (clearance) for engaging the projection 97A with the through hole 98A, the cross-sectional diameter $d_1$ of the projection 97A should preferably be set to 1.9 mm or more and 2.0 mm or less. Each through hole 98A is a long hole with a size $d_2$ along the longitudinal direction being set to 5 mm while a size $d_3$ along the short direction being set to 2 mm. In actuality, in consideration of allowance (clearance) for engaging the through hole 98 with the projection 97A, the size $d_3$ along the short direction should preferably be set to 2.0 mm or more and 2.1 mm or less.

According to this configuration, upon engagement of the through hole 98A provided on the bottom face B of the groove section G of the holding frame 98 with the projection 97A provided on the fixed pressing member 97, the fixed pressing member 97 is constantly held in a stable position with respect to the heating roller 91A in the conveyance direction of the sheet S. Therefore, it becomes possible to prevent the fixed pressing member 97 from being displaced with respect to the conveyance direction of the sheet S during assembling operation for housing the fixed pressing member 97 into the holding frame 98 as well as during operation for solving such problem as sheet jam. Particularly, the engagement position is placed in a downstream position with respect to the conveyance direction of the sheet S, so that the displacement may be prevent more effectively. Moreover, by providing the silicone rubber 100 as the pressing section, it also becomes possible to prevent the fixed pressing member 97 from being displaced toward the upstream direction with respect to the conveyance direction of the sheet S by conveyance of the sheet S. Therefore, the positioning accuracy in the conveyance direction of the sheet S can be enhanced. With the enhanced positioning accuracy, it becomes possible to prevent increase in paper sheet conveyance speed ratio, that is a ratio of the conveyance speed of both the end sections of the sheet S to the conveyance speed of the central section of the sheet S, as well as to prevent variation of the nip width. Therefore, it becomes possible to structure an image forming apparatus which can solve problems such as paper wrinkling, poor paper feed and insufficient fixing strength, stabilize sheet conveyance and enhance fixing quality by including the fixing device of this example in the image forming apparatus.

Moreover, the engaging members are constituted of the through hole 98A and the projection so that the fixed pressing member 97 can be mounted on the holding frame 98 without being easily displaced during assembling operation for housing the fixed pressing member 97 into the holding frame 98. Moreover, the through hole 98A and the projection 97A which are engaging members are each provided in two positions which are distanced from each other with respect to the width direction of the sheet S, so that it becomes possible to prevent the fixed pressing member 97 from being displaced with respect to the conveyance direction of the sheet and to further prevent the fixed pressing member from inclining during assembling operation for housing the fixed pressing member 97 into the holding frame 98 as well as during operation for solving such problem as sheet jam.

The projection 97A is constituted of a pin having a circular cross section, so that the pin comes not into face contact but into point contact with the through hole 98A. This may prevent the inclination caused by the face contact. Further, the fixed pressing member 97 is engaged with the holding frame 98 at two locations, so that the engagement between the fixed pressing member 98 and the holding frame 97 is achieved with sufficient accuracy. Further, the engaging members are placed in a position equivalent to the downstream area with respect to the conveyance direction of the sheet, so that the positioning accuracy in the conveyance direction of the sheet S can be enhanced.

Moreover, by providing the pressing section 100, it also becomes possible to prevent the fixed pressing member 97 from being displaced toward an upstream direction with respect to the conveyance direction due to rotation of the rotor for conveyance of the sheet S. If the pressing section is constituted of a heat-resistant elastic body, the positioning accuracy in the conveyance direction of the sheet can further be enhanced without being influenced by the heat from the heating section.

Figure 6:
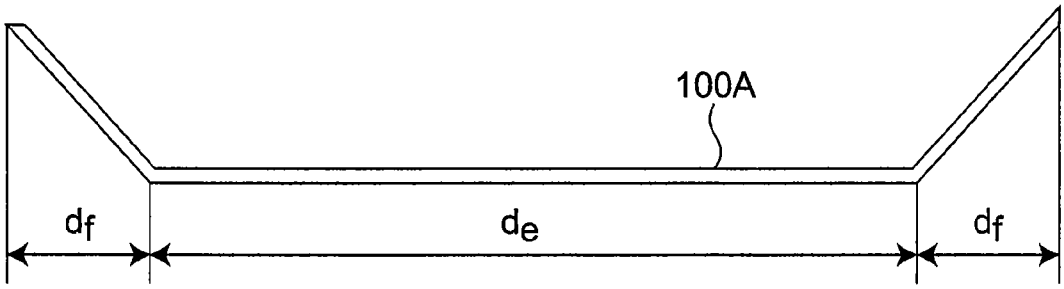
FIG. 6 is a view showing another embodiment of the pressing section in FIG. 2.
Figure 7A:
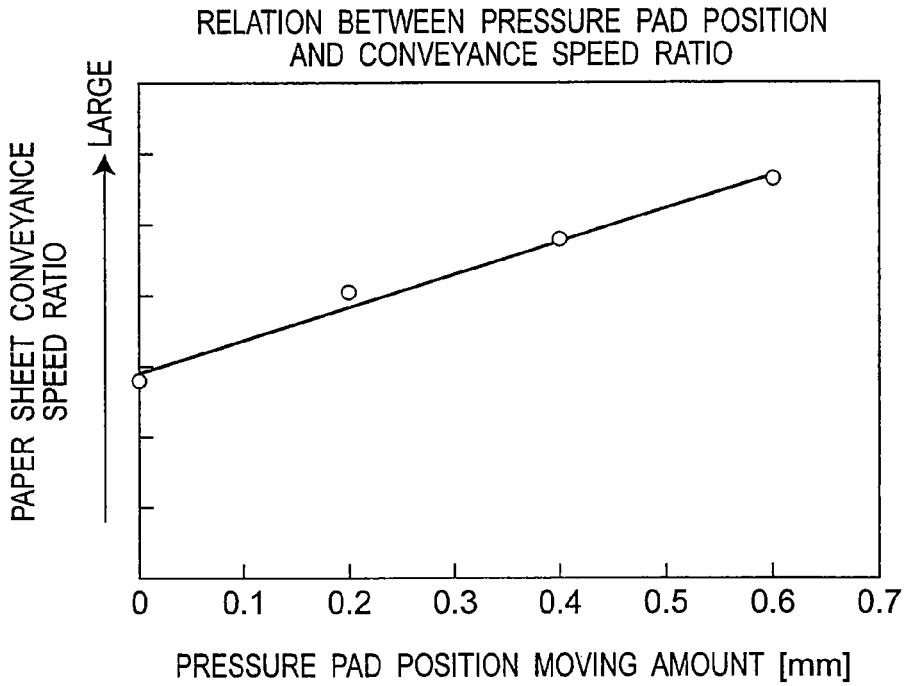
Fig.7A RELATED ART
FIG. 7A is a view showing an experimental result regarding the relation between a pressure pad position of the fixing device and a conveyance speed ratio.
Figure 7A:
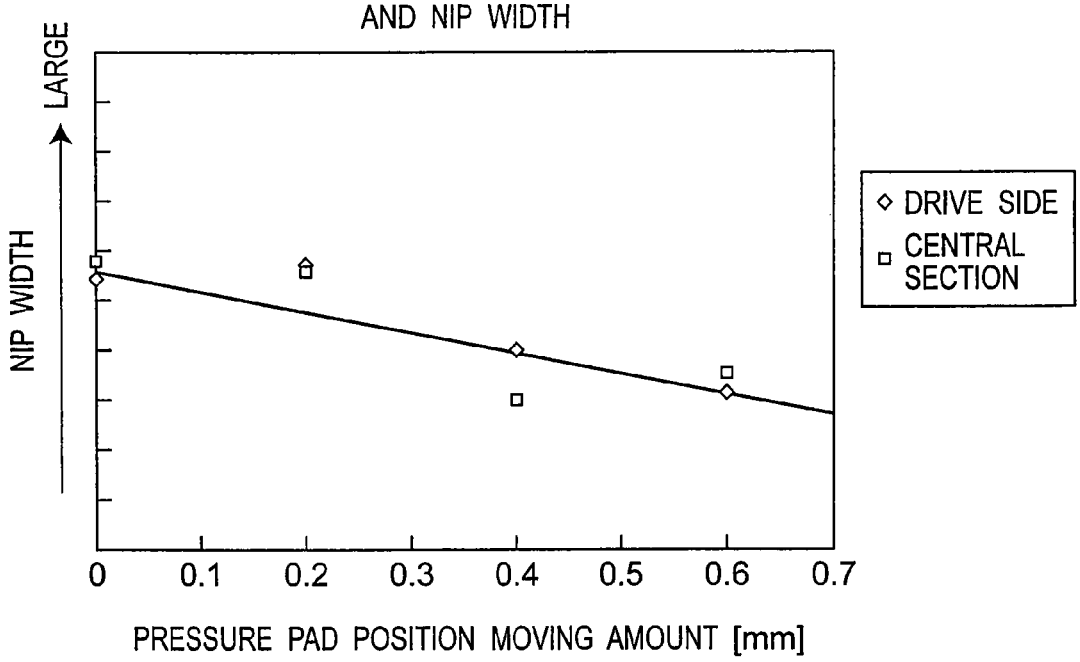
Fig.7A RELATED ART

The present invention shall not be limited to the above-disclosed embodiments. For example, although description has been given of the configuration including the silicone rubber 100, i.e., the elastic body having thermal resistance, as a pressing section for pressing the fixed pressing member toward the direction equivalent to the downstream side in the above-mentioned embodiment, the pressing section is not limited to the silicone rubber 100. For example, as shown in FIG. 6, the pressing section may be a plate spring 100A dimensioned to have a long side section $d_e$ of 200 mm and wing sections $d_f$ of 50 mm. The plate spring 100A bends and, similar to the silicone rubber 100, presses the fixed pressing member 97 toward the holding frame 98 in the direction which is equivalent to the downstream direction with respect to the conveyance direction of the sheet S. Constituting the pressing section from the plate spring achieves enhanced positioning accuracy with a simple configuration. Further, since the plate spring is generally made of metal, it has thermal resistance. Therefore, the plate spring does not receive the influence of the heat by the heating section, which may enhance the endurance of the fixing device. It is to be noted that the pressing section may be omitted.

Moreover, in the above-mentioned embodiment, description has been given of the configuration in which the sheets S of A4 size are stored in the paper cassette 10 so as to be fed from the longitudinal direction of the sheet S. However, the direction of the sheets to be fed is not limited to this direction.

Moreover, although the size of the sheet S is set to A4 and the size of each member is determined accordingly in the above-mentioned embodiment, the numeric values of the sizes are not limited to the values disclosed but may be appropriately changed depending on the size of the sheet, the configuration of devices and the like.

Although the heating roller 91A and the pressure belt 92A constitute the nip section for fixing operation in the above-mentioned embodiment, the fixing device is not limited to this configuration. The fixing device may be configured without the pressure belt 92A so that fixing operation is performed by directly pressing a sheet to the heating roller 91A.

Although the description has been given of the configuration in which the first engaging element is the through hole 98A and the second engaging element is the projection 97A in the above-mentioned embodiment, the first engaging element may not be in the shape of a hole that goes through the holding frame 98 but be in the shape of a recess such as grooves. Although description has been given of the configuration in which the projection 97A serving as a second engaging element is constituted of a pin having a circular cross section, the cross section of the projection 97A may take the shape of polygon such as square and triangle, or other shapes such as projections. Further, in contrast to the configuration of the above-mentioned embodiment, a projection may be provided on the holding frame 98 while a hole may be provided in the fixed pressing member 97 so that these projection and hole may engage with each other.

Moreover in the above-mentioned embodiment, description has been given of the configuration in which the projection 97A provided on the fixed pressing member 97 and the through hole 98A provided in the holding frame 98 are each placed at two locations. However, the number of the placement locations of the first and the second engagement elements is not limited to two but the number may be one or three as long as the holding frame 98 and the fixed pressing member 97 may sufficiently be positioned.

Although in the above-mentioned embodiment, description has been given of the configuration including the pressure member 99 structured so that the elastic pad 96 and the fixed pressing member 97 are housed in the holding frame 98, the elastic pad 96 and the fixed pressing member 97 may be integrally formed or the elastic pad 96 may not be provided at all.

Although in the above-mentioned embodiment, description has been given of the configuration in which the heater 95 is provided as a heating section in the heating roller 91, the heating section may be provided on the endless belt 92 side or in any other place where heating necessary for fixing operation is performed.

What has been disclosed herein is considered in all respects as illustrative. The structure and the material of the apparatus are not limited to those disclosed herein. They can be changed corresponding to apparatuses where necessary.

The image forming apparatus may be any apparatus including monochrome/color copying machines, printers, facsimiles, and multi-functional machines having these functions.

As is described above, the image forming apparatus of the first aspect of the present invention comprises:

a rotor and a fixed pressing member for forming a nip section for fixing an image onto a conveyed sheet, the rotor and the fixed pressing member extending along a width direction of the sheet;

a heating section for heating the rotor to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the fixed pressing member are put in pressure contact with each other, and wherein a first engaging element is provided in a predetermined position on a bottom face of the groove section of the holding frame, while a second engaging element which engages with the first engaging element is provided in a position on the fixed pressing member, the position corresponding to the first engaging element of the holding frame.

The image forming apparatus of the second aspect of the present invention comprises:

a rotor and an endless belt for forming a nip section for fixing an image onto a conveyed sheet;

a fixed pressing member which comes into sliding contact with an inner surface of the endless belt, the rotor, the endless belt and the fixed pressing member extending along a width direction of the sheet;

a heating section for heating either one of the rotor and the endless belt to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the endless are put in pressure contact with each other, and wherein a first engaging element is provided in a predetermined position on a bottom face of the groove section of the holding frame, while a second engaging element which engages with the first engaging element is provided in a position on the fixed pressing member, the position corresponding to the first engaging element of the holding frame.

In one embodiment of the fixing device, the first engaging element is provided in two locations on the holding frame which are distanced from each other with respect to the width direction of the sheet, and wherein the second engaging element is provided in two locations on the fixed pressing member which respectively correspond to the locations of the first engaging element on the holding frame.

In this one embodiment of the fixing device, the engagement elements are provided in two locations which are distanced from each other with respect to the width direction of the sheet, so that it becomes possible to prevent the fixed pressing member from being displaced with respect to the conveyance direction of the sheet as well as to prevent the fixed pressing member from inclining during assembling operation for housing the fixed pressing member into the holding frame as well as during operation for solving such problem as sheet jam.

In one embodiment of the fixing device, the first engaging element is a hole, and the second engaging element is a projection.

In this one embodiment of the fixing device, the engaging members are constituted of the through hole and the projection so that the fixed pressing member can be mounted on the holding frame without being easily displaced during assembling operation for housing the fixed pressing member into the holding frame.

In one embodiment of the fixing device, the projection comprises a pin having a circular cross section.

In this one embodiment of the fixing device, the projection is constituted of a pin having a circular cross section, so that the pin comes not into face contact but into point contact with the through hole, which may prevent the inclination caused by the face contact. Further, the fixed pressing member is engaged with the holding frame at two locations, so that the engagement between the fixed pressing member and the holding frame is achieved with sufficient accuracy.

In one embodiment of the fixing device, the first engaging element is provided in a position on the bottom face of the groove section of the holding frame which is equivalent to a downstream area with respect to the conveyance direction of the sheet.

In this one embodiment of the fixing device, the engaging members are provided in a position equivalent to a downstream area with respect to the conveyance direction of the sheet, so that the positioning accuracy may be enhanced in the conveyance direction of the sheet.

In one embodiment of the fixing device, a pressing section for pressing the fixed pressing member toward the holding frame in a direction which is equivalent to a downstream direction with respect to the conveyance direction of the sheet is mounted on the groove section of the holding frame.

In this one embodiment of the fixing device, by providing the pressing section, it also becomes possible to prevent the fixed pressing member from being displaced toward an upstream direction with respect to the conveyance direction due to rotation of the rotor for conveyance of the sheet. Therefore, the positioning accuracy in the conveyance direction of the sheet can be enhanced.

In one embodiment of the fixing device, the pressing section is a plate spring.

In this one embodiment of the fixing device, by providing the plate spring, it becomes possible to enhance the positioning accuracy with a simple configuration. Further, since the plate spring is generally made of metal, it has thermal resistance. Therefore, the plate spring does not receive the influence of the heat by the heating section, which may enhance the endurance of the fixing device.

The fixing device according to claim 7, wherein the pressing section is made of a heat-resistant elastic body.

In this one embodiment of the fixing device, the positioning accuracy in the conveyance direction of the sheet can further be enhanced without being influenced by the heat from the heating section.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fixing device comprising:

a rotor and a fixed pressing member for forming a nip section for fixing an image onto a conveyed sheet, the rotor and the fixed pressing member extending along a width direction of the sheet;

a heating section for heating the rotor to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the fixed pressing member are put in pressure contact with each other, and wherein a first engaging element is provided in a predetermined position on a bottom face of the groove section of the holding frame, while a second engaging element which engages with the first engaging element is provided on the fixed pressing member.

2. The fixing device according to claim 1, wherein the first engaging element is provided in two locations on the holding frame which are distanced from each other with respect to the width direction of the sheet, and wherein the second engaging element is provided in two locations on the fixed pressing member which respectively correspond to the locations of the first engaging element on the holding frame.

3. The fixing device according to claim 1, wherein the first engaging element is a hole, and the second engaging element is a projection.

4. The fixing device according to claim 3, wherein the projection comprises a pin having a circular cross section.

5. The fixing device according to claim 1, wherein the first engaging element is provided in a downstream position on the bottom face of the groove section of the holding frame with respect to the conveyance direction of the sheet.

6. The fixing device according to claim 1, wherein a pressing section for pressing the fixed pressing member toward the holding frame in a downstream direction with respect to the conveyance direction of the sheet is mounted on the groove section of the holding frame.

7. The fixing device according to claim 6, wherein the pressing section is a plate spring.

8. The fixing device according to claim 6, wherein the pressing section is made of a heat-resistant elastic body.

9. A fixing device comprising:

a rotor and an endless belt for forming a nip section for fixing an image onto a conveyed sheet;

a fixed pressing member which comes into sliding contact with an inner surface of the endless belt, the rotor, the endless belt and the fixed pressing member extending along a width direction of the sheet;

a heating section for heating either the rotor or the endless belt to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the endless belt are put in pressure contact with each other, and wherein a first engaging element is provided in a predetermined position on a bottom face of the groove section of the holding frame, while a second engaging element which engages with the first engaging element is provided on the fixed pressing member.

10. The fixing device according to claim 9, wherein the first engaging element is provided in two locations on the holding frame which are distanced from each other with respect to the width direction of the sheet, and wherein the second engaging element is provided in two locations on the fixed pressing member which respectively correspond to the locations of the first engaging element on the holding frame.

11. The fixing device according to claim 9, wherein the first engaging element is a hole and the second engaging element is a projection.

12. The fixing device according to claim 11, wherein the projection comprises a pin having a circular cross section.

13. The fixing device according to claim 9, wherein the first engaging element is provided in a downstream position on the bottom face of the groove section of the holding frame with respect to the conveyance direction of the sheet.

14. The fixing device according to claim 9, wherein a pressing section for pressing the fixed pressing member toward the holding frame in a downstream direction with respect to the conveyance direction of the sheet is mounted on the groove section of the holding frame.

15. The fixing device according to claim 14, wherein the pressing section is a plate spring.

16. The fixing device according to claim 14, wherein the pressing section is made of a heat-resistant elastic body.

17. An image forming apparatus, comprising:

an image forming section for attaching toner to a sheet; and a fixing device for fixing the toner onto the sheet, the fixing device comprising:

a rotor and a fixed pressing member for forming a nip section for fixing an image onto a conveyed sheet, the rotor and the fixed pressing member extending along a width direction of the sheet;

a heating section for heating the rotor to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the fixed pressing member are put in pressure contact with each other, and wherein a first engaging element is provided in a predetermined position on a bottom face of the groove section of the holding frame, while a second engaging element which engages with the first engaging element is provided on the fixed pressing member.

18. An image forming apparatus, comprising:

an image forming section for attaching toner to a sheet; and a fixing device for fixing the toner onto the sheet, the fixing device comprising:

a rotor and an endless belt for forming a nip section for fixing an image onto a conveyed sheet;

a fixed pressing member which comes into sliding contact with an inner surface of the endless belt, the rotor, the endless belt and the fixed pressing member extending along a width direction of the sheet;

a heating section for heating either one of the rotor and the endless belt to a fixing temperature; and a holding frame placed along the fixed pressing member on an opposite side of the rotor with respect to the fixed pressing member, wherein the holding frame comprises a groove section having a recessed cross section and extending along the width direction of the sheet for housing the fixed pressing member in the groove section, and presses the fixed pressing member toward the rotor so that the rotor and the endless belt are put in pressure contact with each other, and wherein a first engaging element is provided in a predetermined position on a bottom face of the groove section of the holding frame, while a second engaging element which engages with the first engaging element is provided on the fixed pressing member.

* * * * *